US007450884B2

(12) United States Patent
Lee et al.

(10) Patent No.: US 7,450,884 B2
(45) Date of Patent: Nov. 11, 2008

(54) IMAGE FORMING APPARATUS HAVING PRINTING MEDIUM FEEDING UNIT

(75) Inventors: Jin-soo Lee, Suwon-si (KR); Heung-sup Jeong, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 156 days.

(21) Appl. No.: 11/492,805

(22) Filed: Jul. 26, 2006

(65) Prior Publication Data

US 2007/0031165 A1 Feb. 8, 2007

(30) Foreign Application Priority Data

Aug. 6, 2005 (KR) ..... 10-2005-0072013

(51) Int. Cl.
*G03G 21/00* (2006.01)

(52) U.S. Cl. ..... 399/124

(58) Field of Classification Search ..... 399/124, 399/405

See application file for complete search history.

(56) References Cited

U.S. PATENT DOCUMENTS 6,993,268 B2 * 1/2006 Otaka ..... 399/124
2004/0018034 A1 * 1/2004 Baek et al. ..... 399/405

FOREIGN PATENT DOCUMENTS

| | | |
|---|---|---|
| JP | 05-132185 | 5/1993 |
| JP | 06-009098 | 1/1994 |
| JP | 09-221247 | 8/1997 |
| JP | 11-343037 | 12/1999 |
| JP | 2000-214718 | 8/2000 |
| JP | 2002-220146 | 8/2002 |

* cited by examiner

*Primary Examiner*—David M. Gray
*Assistant Examiner*—Andrew V Do
(74) *Attorney, Agent, or Firm*—Roylance, Abrams, Berdo & Goodman L.L.P.

(57) ABSTRACT

An image forming apparatus having a printing medium feeding unit is provided. The image forming apparatus includes a driving roller and an idle roller which engage with each other and which feed a printing medium, an elastic member which elastically biases the driving roller toward the idle roller, and a releasing member. The releasing member releases the elastic member when a cover door is opened so that the driving roller and idle roller may be separated from one another to remove a jammed printing medium. Accordingly, when a jammed printing medium is removed, the printing medium is not crumpled or torn, parts of the image forming apparatus are not damaged, and the image forming apparatus does not malfunction.

14 Claims, 4 Drawing Sheets

IMAGE FORMING APPARATUS HAVING PRINTING MEDIUM FEEDING UNIT

CROSS-REFERENCE TO RELATED PATENT APPLICATION

This application claims the benefit under 35 U.S.C. § 119 (a) of Korean Patent Application No. 10-2005-0072013, filed on Aug. 6, 2005, in the Korean Intellectual Property Office, the entire disclosure of which is hereby incorporated by reference.

BACKGROUND OF THE INVENTION

1. Field of the Invention

The present invention relates to an image forming apparatus. More particularly, the present invention relates to an image forming apparatus having a printing medium feeding unit for feeding a printing medium.

2. Description of the Related Art

Typical image forming apparatuses such as printers or copy machines include a sheet feeding cassette which stores a printing medium such as a paper or overhead projection film, a printing unit which prints an image onto the printing medium, and a printing medium feeding unit which feeds the printing medium. The printing medium feeding unit is disposed at a position in the printing unit where the printing medium is loaded in and out.

FIG. 1 is a perspective view of a conventional feeding unit for a printing medium P. The feeding medium includes a feed roller 2 and an idle roller 3 facing each other. The printing medium P is fed as the feed roller 2 and the idle roller 3 rotate. When the printing medium P is jammed during feeding, a cover is opened so that the interior of the main frame of an image forming apparatus is exposed, or a sheet feeding cassette 1 that stores the printing medium P is separated from the main frame to remove the jammed printing medium P. The printing medium P caught between the feed roller 2 and the idle roller 3 is pulled to remove the jammed printing medium P. The feed roller 2 and the idle roller 3 are elastically pressed with each other to generate feed force, so a large amount of external force may be needed to pull the printing medium P. At this time, the printing medium P may be crumpled. To prevent the printing medium P from being crumpled, the printing medium P must be pulled carefully and slowly. When the amount of external force to pull the printing medium P exceeds the fracture strength of the printing medium P, the printing medium P may be torn. Further, if excessive force is applied, parts of the apparatus that transfer driving force to the feed roller may be damaged. In addition, it is difficult to remove a torn printing medium P, and the pieces of the torn printing medium P torn may be caught between parts operating in the main frame of the image forming apparatus, so the apparatus may malfunction.

Accordingly, there is a need for an improved printing medium feeding unit which minimizes crumpling and tearing of a printing medium when removing a jammed printing medium.

SUMMARY OF THE INVENTION

An aspect of the present invention is to address at least the above problems and/or disadvantages and to provide at least the advantages described below. Accordingly, an aspect of the present invention is to provide an image forming apparatus having a printing medium feeding unit which can prevent a printing medium from being crumpled or torn when removing a jammed printing medium and which prevents malfunctions of the image forming apparatus due to damaged driving force transfer parts or a torn printing medium.

In accordance with an aspect of the present invention, an image forming apparatus comprises a printing unit which prints an image onto a printing medium, a driving roller and an idle roller engaged with each other and rotated to feed the printing medium, an elastic member which elastically biases the driving roller into contact with the idle roller; an openable and closeable cover door provided at a side of the main frame of the image forming apparatus, and a releasing member which releases the elastic bias of the driving roller and the idle roller when the cover door is open.

The elastic member may be a torsion spring connecting the rotation shaft of the idle roller and the releasing member.

The releasing member may extend to the cover door to elastically contact one end of the torsion spring when the cover door is closed.

The one end of the torsion spring may have a curved portion where it contacts the releasing member.

The image forming apparatus may further comprise a support member which is provided at the main frame of the image forming apparatus and includes an elongated slot that movably supports the driving roller rotation shaft and the idle roller rotation shaft.

The image forming apparatus may further comprise a sheet feeding cassette which stores a printing medium and a pickup roller which picks up the printing medium, sheet by sheet, loaded on the top of the sheet feeding cassette. The driving roller and the idle roller may be provided between the pickup roller and the printing unit to feed the picked up printing medium to the printing unit.

In accordance with another aspect of the present invention, an image forming apparatus comprises a driving roller, an idle roller engaging the driving roller to feed a printing medium, an elastic member for selectively biasing the idle roller and the driving roller toward one another, a cover door for exposing the driving roller and the idle roller, the cover door being movable between an opened position and a closed position, and a releasing member. The releasing member engages the elastic member when the cover door is in a closed position so that the elastic member biases the idle roller and the driving roller toward one another and is disengaged from the elastic member when the cover door is in an opened position so that the idle roller and the driving roller may separate.

The elastic member may be a torsion spring. A first end of the torsion spring contacts a rotation shaft of the idle roller and a second end of the torsion spring contacts the releasing member.

The releasing member may protrude from the cover door to contact the second end of the torsion spring when the cover door is closed.

The second end of the torsion spring may comprise a curved portion.

The image forming apparatus may further comprise a support member comprising an elongated slot that movably supports a rotation shaft of a driving roller and a rotation shaft of the idle roller.

In accordance with another aspect of the present invention, the image forming apparatus may comprise a driving roller, an idle roller engaging the driving roller, a cover for exposing the driving roller and the idle roller, the cover being movable between an opened position and a closed position, and means for selectively applying a biasing force to the idle roller and the driving roller. The biasing means is adapted to apply the biasing force when the cover door is in a closed position, and is adapted to not apply the biasing force when the cover door is in an opened position.

The biasing means may comprise an elastic member for generating a biasing force, and a releasing member for engaging the elastic member and selectively applying the biasing force.

The elastic member may be a torsion spring. A first end of the torsion spring contacts a rotation shaft of the idle roller and a second end of the torsion spring contacts the releasing member.

The releasing member may protrude from the cover door to contact the second end of the torsion spring when the cover door is closed.

The second end of the torsion spring may comprise a curved portion.

The image forming apparatus may further comprise a support member comprising an elongated slot for movably supporting a shaft of the driving roller and a shaft of the idle roller.

BRIEF DESCRIPTION OF THE DRAWINGS

The above and other objects, features, and advantages of certain exemplary embodiments of the present invention will be more apparent from the following description taken in conjunction with the accompanying drawings, in which.

Throughout the drawings, the same reference numerals will be understood to refer to the same elements, features, and structures.

DETAILED DESCRIPTION OF EXEMPLARY EMBODIMENTS

The matters defined in the description such as a detailed construction and elements are provided to assist in a comprehensive understanding of the exemplary embodiments of the invention. Accordingly, those of ordinary skill in the art will recognize that various changes and modifications of the exemplary embodiments described herein can be made without departing from the scope and spirit of the invention. Also, descriptions of well-known functions and constructions are omitted for clarity and conciseness.

Figure 1:
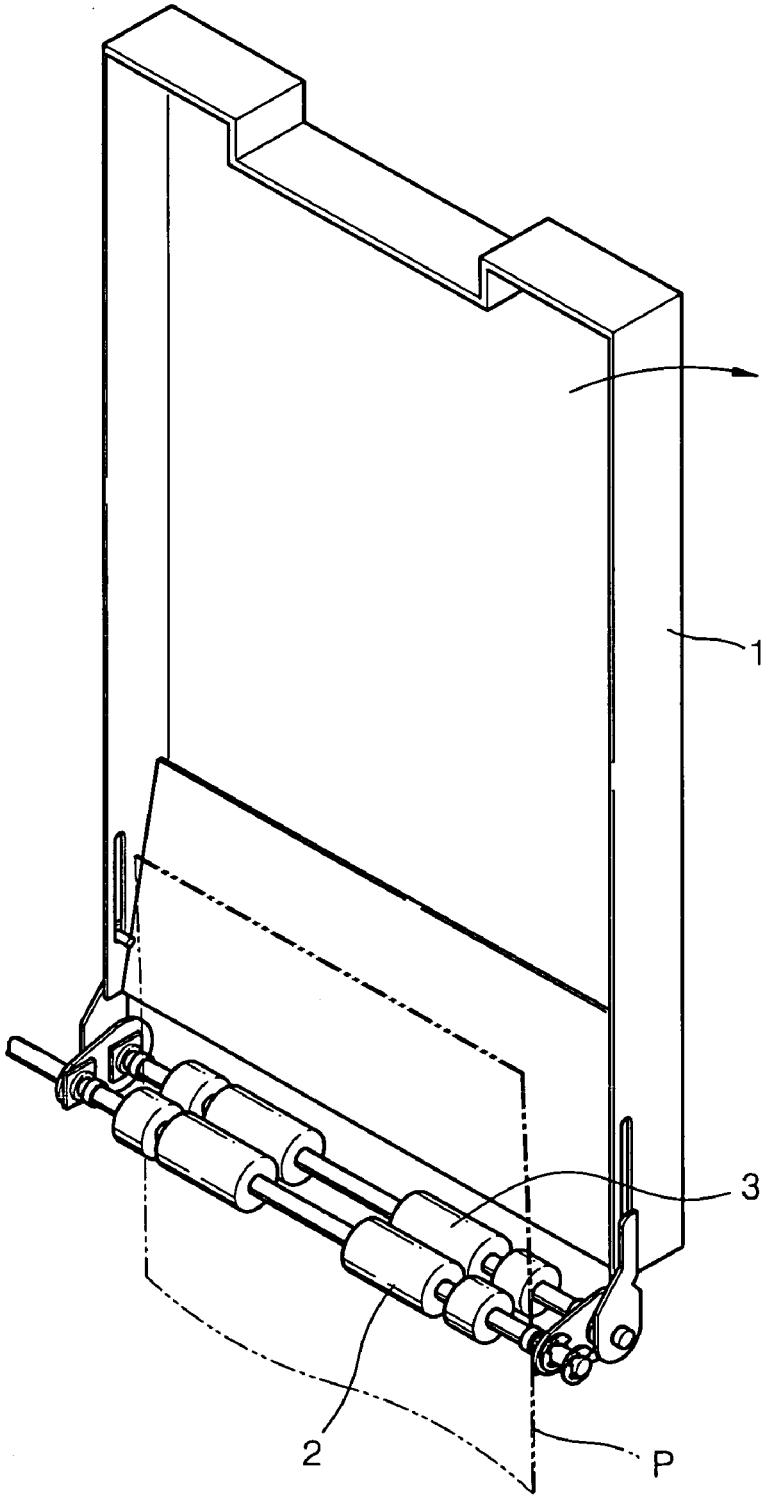
FIG. 1 (PRIOR ART)
FIG. 1 is a perspective view of a conventional printing medium feeding unit.
Figure 2:
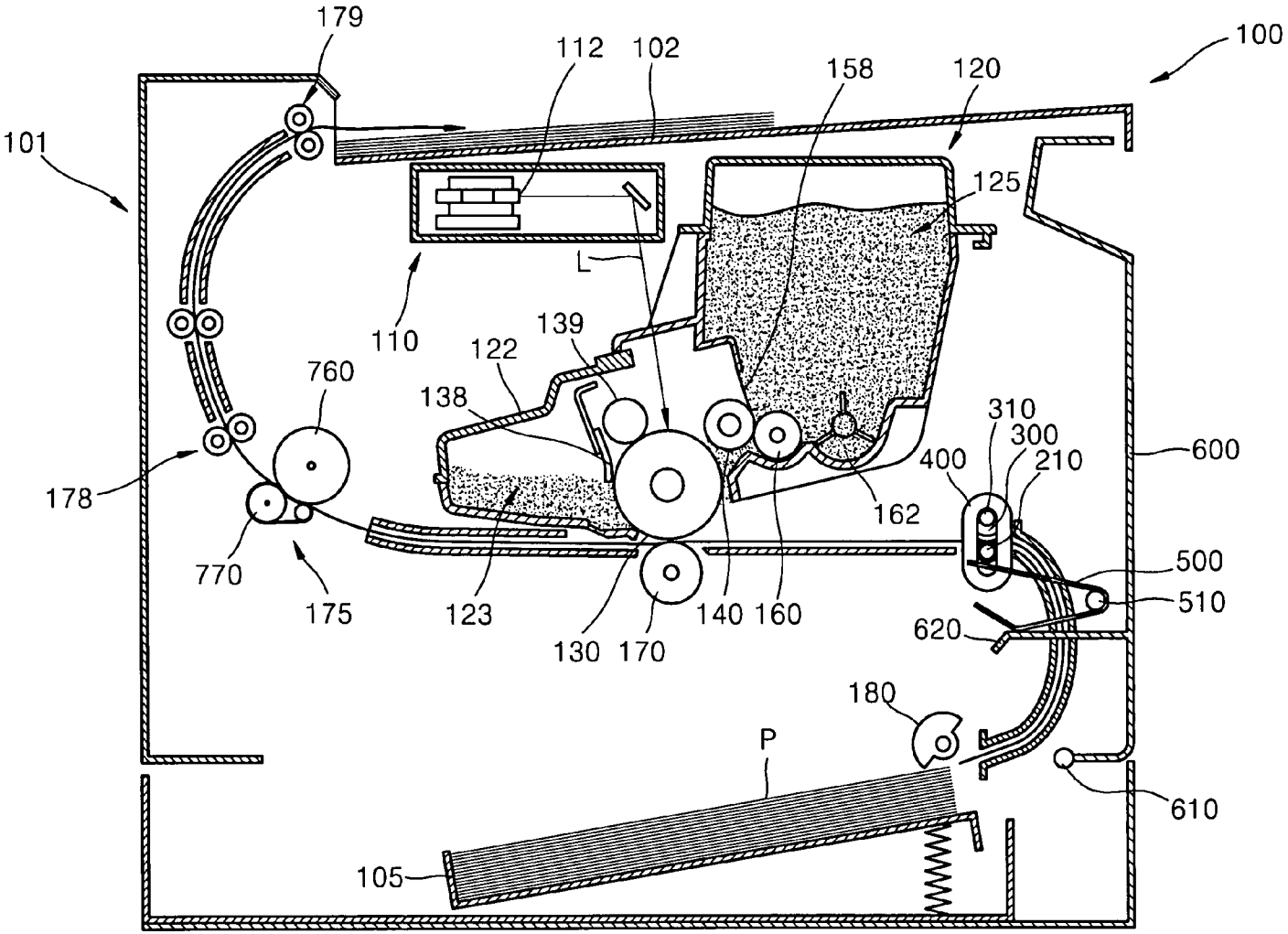
FIG. 2 is a side sectional view of an image forming apparatus having a printing medium feeding unit according to an exemplary embodiment of the present invention.

FIG. 2 is a side sectional view of an image forming apparatus having a printing medium feeding unit according to an exemplary embodiment of the present invention. The image forming apparatus 100 includes a printing unit that transfers a toner image onto a printing medium and a fixing unit 175 that fuses the toner image. The printing unit includes a main frame 101 of the image forming apparatus, a light illuminating unit 110, and a development cartridge 120.

The light illuminating unit 110 forms an electrostatic latent image on the outer circumferential surface of a photoconductor 130 by illuminating light L corresponding to image data onto the photoconductor 130. The light illuminating unit 110 includes a light source (not shown) that illuminates a laser beam and a beam deflector 112 that deflects the laser beam illuminated by the light source.

The development cartridge 120 is placed in the main frame 101 of the image forming apparatus in a detachable manner. The development cartridge 120 includes a developing roller 140 facing the photoconductor 130. A development cartridge housing 122 forms the enclosure of the development cartridge 120. The photoconductor 130, a charging roller 139, a cleaning member 138, a developing roller 140, a toner layer control member 158, a supply roller 160, and an agitator 162 are provided in the development cartridge housing 122. A waste toner storage 123 that stores waste toner removed from the photoconductor 130 and a toner storage 125 that stores toner are also provided. The development cartridge 120 is replaced when the toner stored in the toner storage 125 is used up.

The photoconductor 130, which is disposed such that a portion of the outer circumferential surface thereof is exposed, rotates in a predetermined direction, and a photoconductive layer is coated on the outer circumferential surface of the cylindrical drum by deposition, for example. The photoconductor 130 is charged to have a predetermined electric potential by the charging roller 139, and the electrostatic latent image corresponding to a desired image is formed on the outer circumferential surface thereof by the use of light L illuminated by the light illuminating unit 110.

The developing roller 140 contains toner in solid powder form and develops the toner into a toner image by supplying the toner to the electrostatic latent image formed onto the photoconductor 130. A development bias voltage is applied to the developing roller 140 so as to supply the toner to the photoconductor 130. The outer circumferential surfaces of the developing roller 140 and the photoconductor 130 may come in contact with each other to form a development nip, or may be separated from each other to form a development gap. The development nip or development gap must be uniform to have a predetermined size along the axial direction of the developing roller 140 and the photoconductor 130.

The supply roller 160 supplies toner so that toner is attached to the developing roller 140. The agitator 162 stirs the toner, so that toner in the toner storage 125 does not harden, and feeds toner towards the supply roller 160. The toner layer control member 158 controls the thickness of the toner attached onto the outer circumferential surface of the developing roller 140.

The cleaning member 138 is disposed on the development cartridge housing 122 and comes into contact with the photoconductor 130 with a predetermined pressure, so that toner remaining on the photoconductor 130 after transferring is scraped off.

A transfer roller 170 faces the outer circumferential surface of the photoconductor 130, and a transfer bias voltage having the opposite polarity with respect to the toner image is applied thereto, so that the toner image developed on the photoconductor 130 is transferred onto the printing medium P. The toner image is transferred onto the printing medium P by electrostatic force acting between the photoconductor 130 and the transfer roller 170 and by mechanical contact pressure.

The fixing unit 175 includes a heating roller 760 and a pressure roller 770 facing each other and fuses the toner image onto the printing medium P by applying heat and pressure to the toner image transferred onto the printing medium P.

A de-curl unit 178 removes curls of the printing medium P caused by the heat of the fixing unit 175. A paper-discharging roller 179 discharges the printing medium P, when finished fusing, out of the image forming apparatus 100. The discharged printing medium P is loaded on a paper-out tray 102.

The transferring path of the printing medium P will now be described. The image forming apparatus 100 includes a paper-loading cassette 105 on which the printing medium P is loaded. A pickup roller 180 picks up the loaded printing medium P, sheet by sheet, to be used.

The printing medium feeding unit includes a driving roller 300, an idle roller 200, a support member 400, an elastic member 500, and a releasing member 620. In FIG. 2, the printing medium feeding unit is disposed between the pickup roller 180 and the printing unit, and the printing medium P loaded, sheet by sheet, by the pickup roller 180 is fed towards the printing unit. The printing medium feeding unit of the present invention may be disposed at any position in the printing unit where the printing medium P is loaded.

Figure 3:
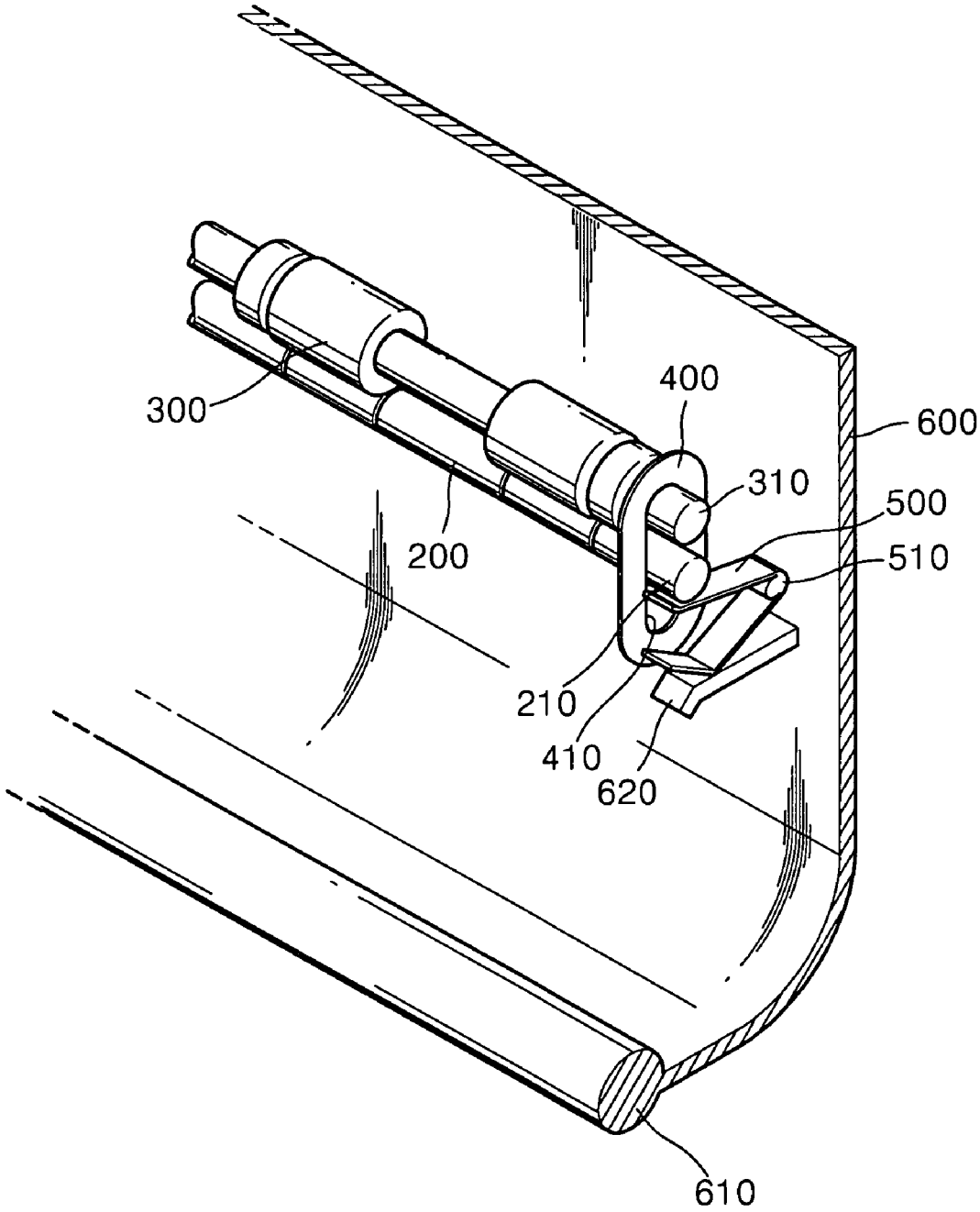
FIG. 3 is a perspective view of the printing medium feeding unit according to an exemplary embodiment of the present invention.
Figure 4:
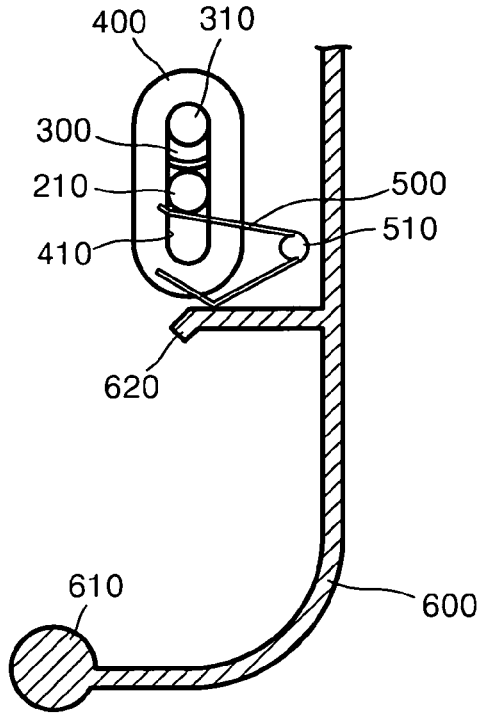
FIG. 4 is a side sectional view of the printing medium feeding unit according to an exemplary embodiment of the present invention, where a cover door is closed.
Figure 5:
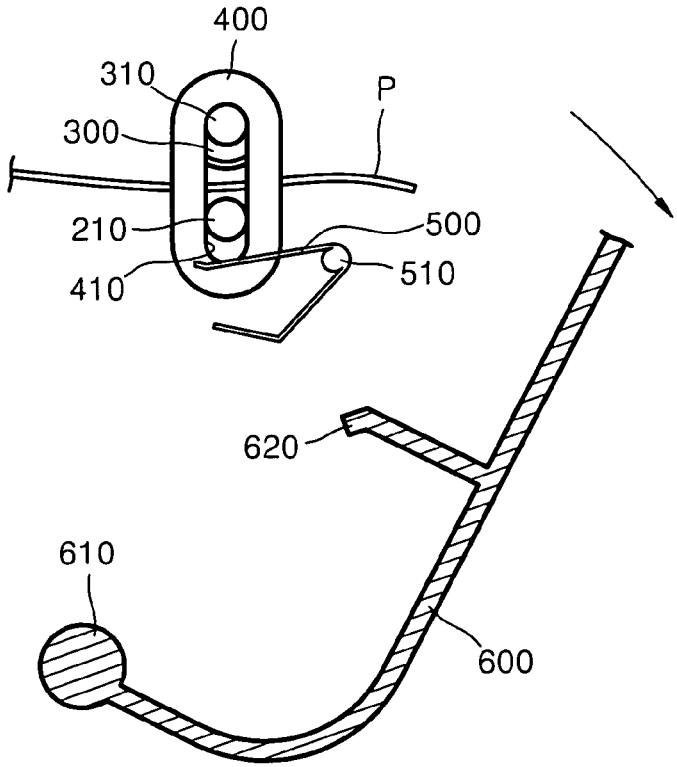
FIG. 5 is a side sectional view of the printing medium feeding unit according to an exemplary embodiment of the present invention, where a cover door is open.

FIG. 3 is a perspective view of the printing medium feeding unit according to an exemplary embodiment of the present invention. FIG. 4 is a side sectional view according to an exemplary embodiment of the printing medium feeding unit of the present invention, with a cover door 600 closed. FIG. 5 is a side sectional view of the printing medium feeding unit according to an exemplary embodiment of the present invention, with the cover door 600 open. As seen in FIGS. 3 through 5, the driving roller 300 provides the feed force by which the picked-up printing medium P is fed towards the transfer roller 170. The driving roller 300 is connected to a driving source (not shown) by means of a power transfer part (not shown) to receive power. The driving roller 300 and the power transfer part may be damaged when the jammed printing medium P is pulled out with excessive force. Further, parts of the main frame 101 of the image forming apparatus may not operate properly when the torn printing medium P is caught in the driving roller 300 or in the power transfer part during operation.

The idle roller 200 engaged with the driving roller 300 feeds the printing medium P. A driving roller rotation shaft 310 and an idle roller rotation shaft 210 are movably supported by a slot 410 formed at the support member 400. Alternatively, the driving roller rotation shaft 310 may be fixed inside or outside the slot 410, and the idle roller rotation shaft 210 may be movably supported.

The support member 400 is fixed to the main frame 101 of the image forming apparatus. The support member 400 includes an elongated slot 410. The slot 410 movably supports the driving roller rotation shaft 310 and the idle roller rotation shaft 210. When the cover door 600 is closed, the driving roller rotation shaft 310 and the idle roller rotation shaft 210 are moved, so that the idle roller 300 and the driving roller 300 are elastically contacted. The driving roller rotation shaft 310 and the idle roller rotation shaft 210 are moved by the elastic force of the elastic member 500. The driving roller rotation shaft 310 stops moving when it contacts one end of the slot 410. The end of the slot 410 functions as a stopper. When the driving roller rotation shaft 310 stops moving, the idle roller rotation shaft 210 also stops moving. The idle roller 200 and the driving roller 300 are constantly pressed by the elastic member 500.

The contact force of the idle roller 200 and the driving roller 300 is released when the cover door 600 is open. This is because the releasing member 620 releases the elastic member 500, and thereby releases the elastic force that biases the idle roller rotation shaft 210 toward the driving roller rotation shaft 310. When the biasing force is released, the idle roller 200 and the driving roller 300 separate from each other due to the weight of the components. A jammed printing medium P can be removed with less pulling force because the pressure that the idle roller 200 and the driving roller 300 apply on the printing medium P is released.

As an example of the elastic member 500, a torsion spring is provided. Although not shown, a compression spring may be used as another example of the elastic member 500. As an example for the torsion spring, a coil or a leaf spring may be used. The center portion of torsion in the torsion spring is rotatably engaged to an elastic member hinge 510. The ends of the torsion spring contact the idle roller rotation shaft 210 and the releasing member 620 when the cover door 600 is closed. The releasing member 620 functions as a supporting surface, and the outer circumferential surfaces of the idle roller 200 and the driving roller 300 are pressed into contact by the force of the torsion spring acting on the idle roller rotation shaft 210. When the cover door 600 is open, the releasing member 620 is removed from the end of the torsion spring. Therefore, the end of the torsion spring does not apply an elastic force to the idle roller rotation shaft 210. The driving roller rotation shaft 310 and the idle roller rotation shaft 210 can freely move in the slot 410 when the elastic force of the idle roller rotation shaft 210 is released.

The cover door 600 is pivotable about a cover door hinge 610 provided at the main frame 101 of the image forming apparatus. The cover door 600 is closed to protect the interior of the main frame 101 of the image forming apparatus. The cover door 600 is opened to expose the interior of the main frame 101 of the image forming apparatus to remove the jammed printing medium P or perform other maintenance operations.

The releasing member 620 is provided at the cover door 600. The releasing member 620 releases the elastic bias of the driving roller rotation shaft 310 and the idle roller rotation shaft 210 when the cover door 600 is open. The releasing member 620 causes the elastic member 500 to elastically bias the idle roller rotation shaft 210 towards the driving roller 300 when the cover door 600 is closed.

Accordingly, in an image forming apparatus according to an exemplary embodiment of the present invention, when a cover door is opened to remove a jammed printing medium, the elastic contact between the driving roller and the idle roller is released. This allows a printing medium to be removed without being crumpled or torn, minimizes damage to parts transferring a driving force to the driving roller, and minimizes malfunctions of the image forming apparatus.

While the invention has been shown and described with reference to certain exemplary embodiments thereof, it will be understood by those skilled in the art that various changes in form and details may be made therein without departing from the spirit and scope of the invention as defined by the appended claims.

What is claimed is:

1. An image forming apparatus comprising:

a printing unit for printing an image onto a printing medium;

a driving roller and an idle roller engaging each other and rotating to feed the printing medium;

an elastic member for elastically biasing the driving roller and the idle roller into contact;

a cover door disposed on a main frame of the image forming apparatus, the cover door being movable between an opened position and a closed position;

a releasing member which releases the elastic bias of the driving roller and the idle roller when the cover door is in the opened position; and a support member provided at the main frame of the image forming apparatus, the support member comprising an elongated slot that movably supports the driving roller rotation shaft and the idle roller rotation shaft.

2. The image forming apparatus according to claim 1, wherein the elastic member comprises a torsion spring, a first end of the torsion spring contacting a rotation shaft of the idle roller and a second end of the torsion spring contacting the releasing member.

3. The image forming apparatus according to claim 2, wherein the releasing member protrudes from the cover door to contact the second end of the torsion spring when the cover door is closed.

4. The image forming apparatus according to claim 3, wherein the second end of the torsion spring comprises a curved portion.

5. The image forming apparatus according to claim 1, further comprising:

a sheet feeding cassette for storing a printing medium; and a pickup roller for picking up the printing medium, sheet by sheet, loaded in the sheet feeding cassette, wherein the driving roller and the idle roller are provided between the pickup roller and the printing unit to feed the picked up printing medium to the printing unit.

6. An image forming apparatus comprising:

a driving roller;

an idle roller engaging the driving roller to feed a printing medium;

an elastic member for selectively biasing the idle roller and the driving roller toward one another;

a cover door for exposing the driving roller and the idle roller, the cover door being movable between an opened position and a closed position;

a releasing member for engaging the elastic member when the cover door is in a closed position so that the elastic member biases the idle roller and the driving roller toward one another and for disengaging the elastic member when the cover door is in an opened position so that the idle roller and the driving roller may separate; and a support member comprising an elongated slot that movably supports a rotation shaft of a driving roller and a rotation shaft of the idle roller.

7. The image forming apparatus according to claim 6, wherein the elastic member comprises a torsion spring, a first end of the torsion spring contacting a rotation shaft of the idle roller and a second end of the torsion spring contacting the releasing member.

8. The image forming apparatus according to claim 7, wherein the releasing member protrudes from the cover door to contact the second end of the torsion spring when the cover door is closed.

9. The image forming apparatus according to claim 8, wherein the second end of the torsion spring comprises a curved portion.

10. An image forming apparatus comprising:

a driving roller;

an idle roller engaging the driving roller;

a cover for exposing the driving roller and the idle roller, the cover being movable between an opened position and a closed position;

means for selectively applying a biasing force to the idle roller and the driving roller, the biasing means being adapted to apply the biasing force when the cover door is in a closed position, and being adapted to not apply the biasing force when the cover door is in an opened position; and a support member comprising an elongated slot for movably supporting a shaft of the driving roller and a shaft of the idle roller.

11. The image forming apparatus according to claim 10, wherein the biasing means comprises:

an elastic member for generating a biasing force; and a releasing member for engaging the elastic member and selectively applying the biasing force.

12. The image forming apparatus according to claim 11, wherein the elastic member comprises a torsion spring, a first end of the torsion spring contacting a rotation shaft of the idle roller and a second end of the torsion spring contacting the releasing member.

13. The image forming apparatus according to claim 12, wherein the releasing member protrudes from the cover door to contact the second end of the torsion spring when the cover door is closed.

14. The image forming apparatus according to claim 13, wherein the second end of the torsion spring comprises a curved portion.

* * * * *